US006309326B1

(12) United States Patent
Huang

(10) Patent No.: US 6,309,326 B1
(45) Date of Patent: Oct. 30, 2001

(54) EXERCISE MACHINE WITH MEANS TO TWIRL THE WAIST OF A USER

(76) Inventor: Jui-Chang Huang, 33 Pa Der Rd., Pei Tou Township, Chan Hua Hsien (TW)

( * ) Notice: Subject to any disclaimer, the term of this patent is extended or adjusted under 35 U.S.C. 154(b) by 0 days.

(21) Appl. No.: 09/624,409

(22) Filed: Jul. 24, 2000

(51) Int. Cl.[7] ..... A63B 21/00
(52) U.S. Cl. ..... 482/57; 482/146; 482/7
(58) Field of Search ..... 482/51, 57, 63, 482/72, 73, 95, 146, 147, 114, 115, 142

(56) References Cited

U.S. PATENT DOCUMENTS 5,658,227 * 8/1997 Stearns ..... 482/96
6,048,293 * 4/2000 Lee ..... 482/140
6,149,552 * 11/2000 Chen ..... 482/72

* cited by examiner

*Primary Examiner*—Stephen R. Crow
(74) *Attorney, Agent, or Firm*—Harrison & Egbert

(57) ABSTRACT

An exercise machine including a base on which a box body is mounted. The box body is provided with two locating spring pieces which are fastened with an upper locating block. The box body is further provided to a lower locating block. The upper locating block and the lower locating block are provided with a V-shaped slot. A seat rod and a pedal rod are fastened with a braking block which is provided to two tangent surfaces which are engaged with the V-shaped slots of the upper locating block and the lower locating block. The seat rod is provided with a seat pad fastened thereto. The pedal rod is provided with two pedals fastened pivotally thereto.

4 Claims, 12 Drawing Sheets

EXERCISE MACHINE WITH MEANS TO TWIRL THE WAIST OF A USER

BACKGROUND INVENTION

The present invention relates generally to an exercise machine, and more particularly to an exercise machine which is capable of twirling the waist of a user thereof.

DESCRIPTION OF RELATED ART

There are a variety of exercise machines available in the market place today. These conventional exercise machines are generally devoid of a safety feature to safeguard a user thereof.

BRIEF SUMMARY OF THE INVENTION

It is therefore the primary objective of the present invention to provide a safe exercise machine.

It is another objective of the present invention to provide an exercise machine capable of twirling the waist of a user thereof.

The features and the advantages of the present invention will be readily understood upon a thoughtful deliberation of the following detailed description of preferred embodiments of the present invention with reference to the accompanying drawings.

DETAILED DESCRIPTION OF THE INVENTION

Figure 1:
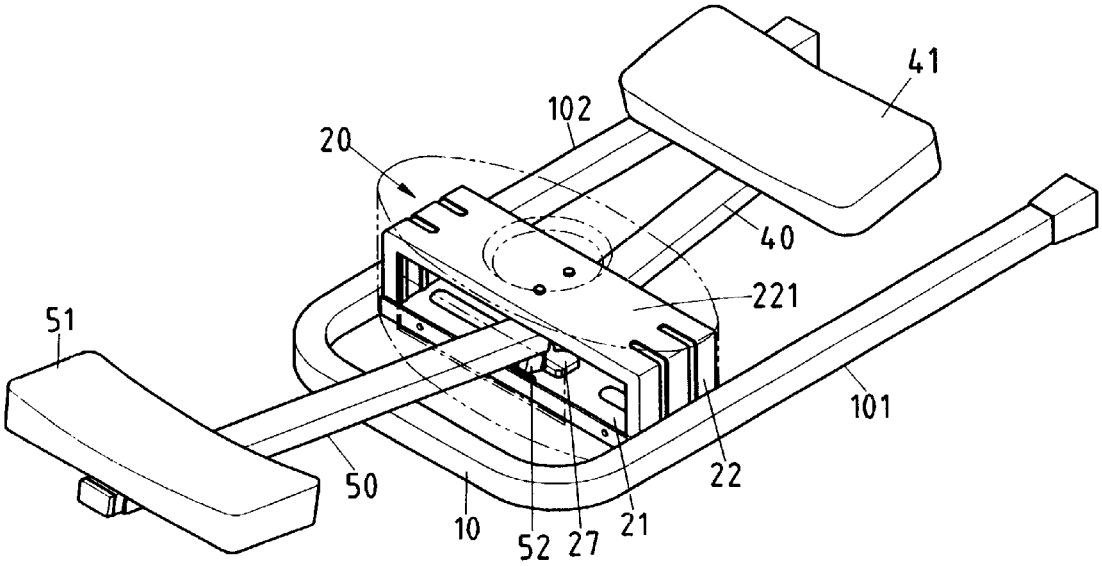
FIG. 1 shows a perspective view of a first preferred embodiment of the present invention.
Figure 2:
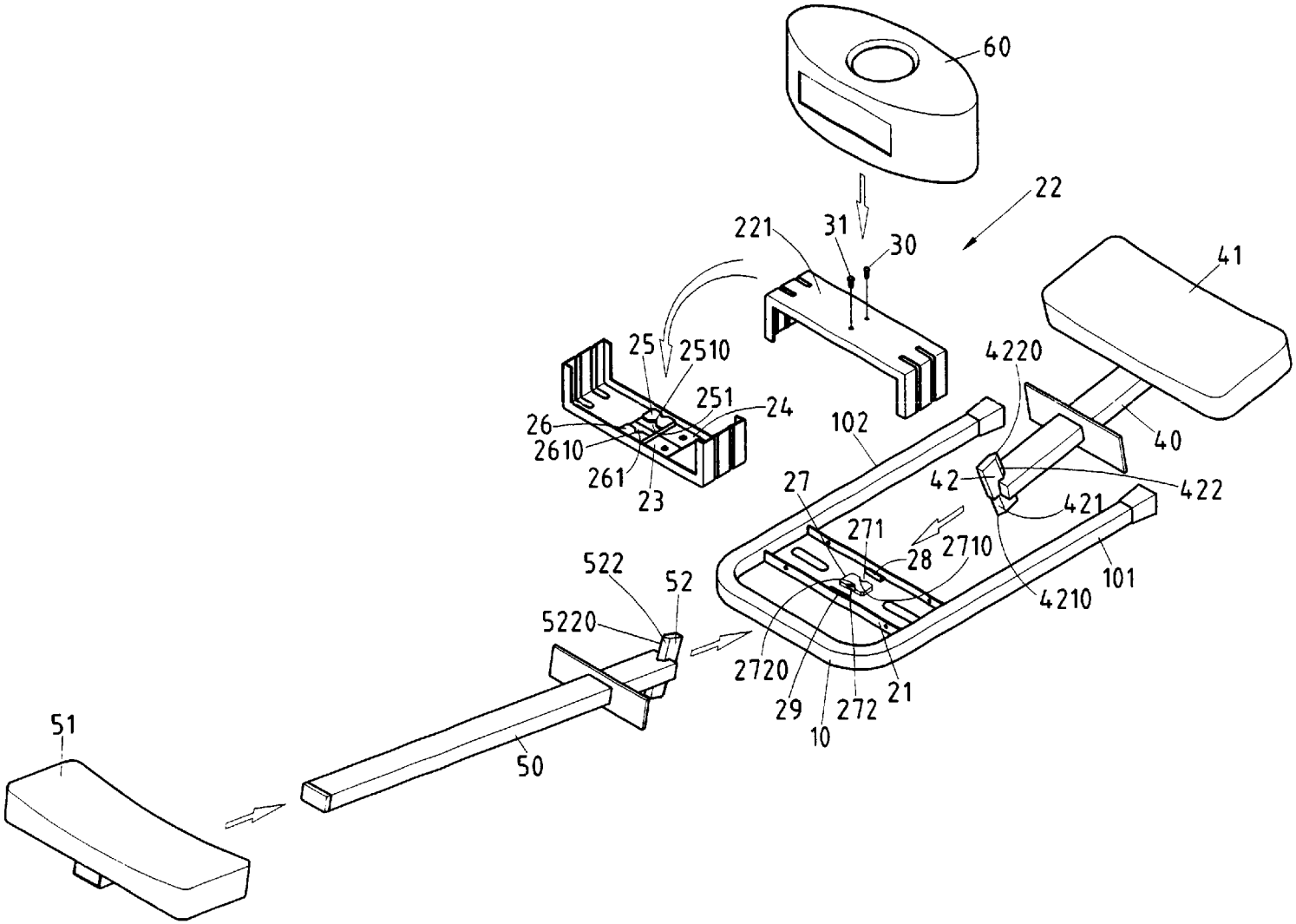
FIG. 2 shows an exploded view of the first preferred embodiment of the present invention.
Figure 3:
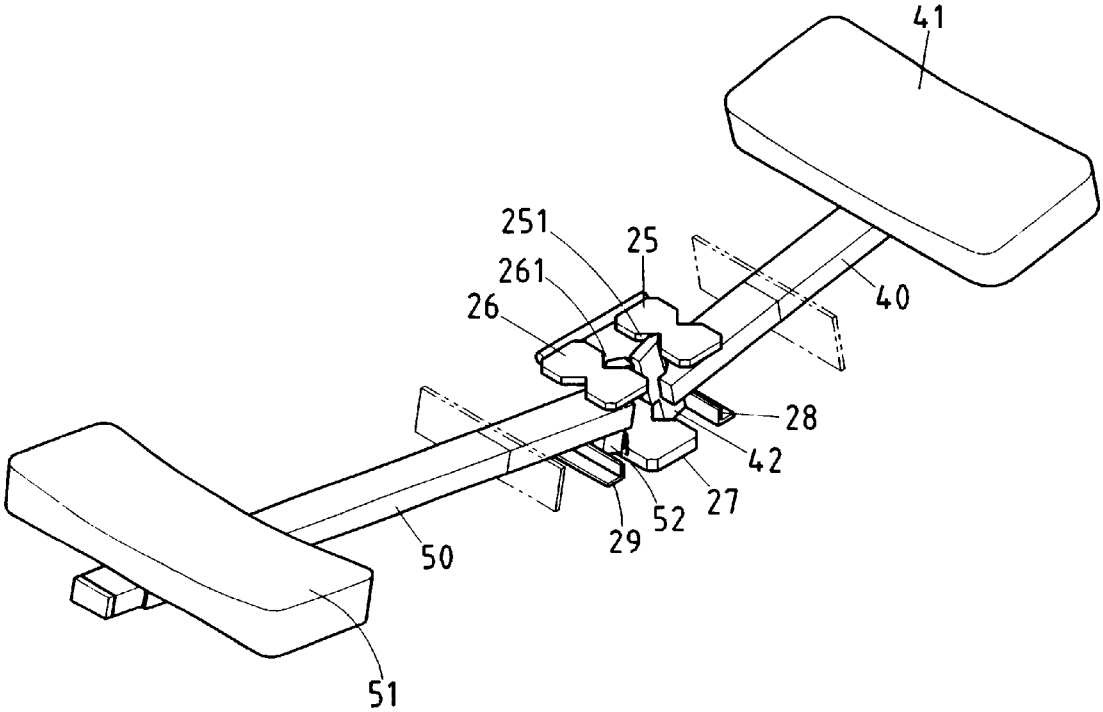
FIG. 3 shows a partial schematic view of the first preferred embodiment of the present invention.

As shown in FIGS. 1–5, an exercise machine embodied in the present invention comprises a base 10, a box body 20, a seat rod 40, a pedal rod 50, and a box cover 60.

The base 10 is rested on the ground and is formed of two locating rods 101 and 102 parallel to each other.

Figure 4:
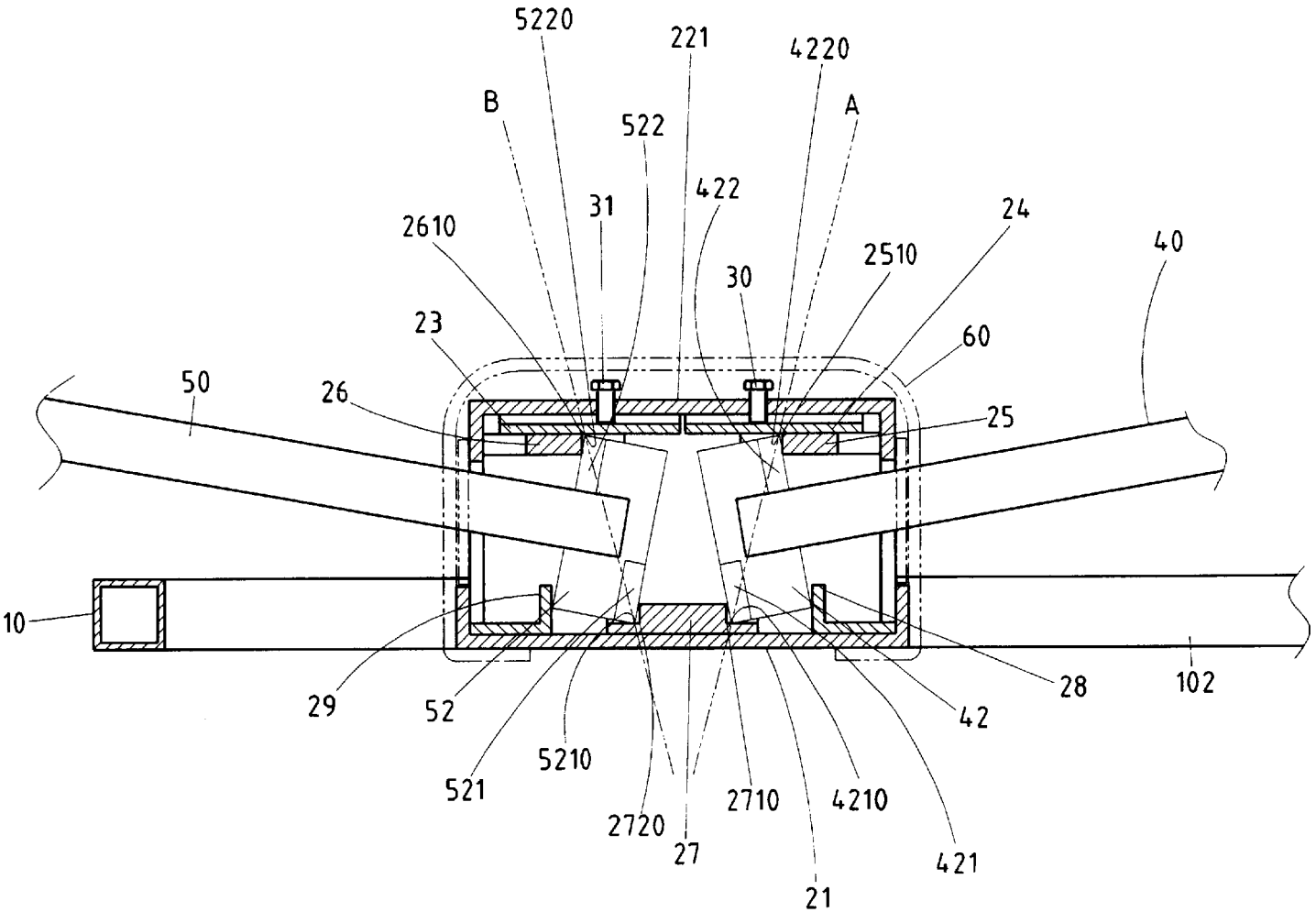
FIG. 4 shows a side sectional view of the first preferred embodiment of the present invention.

The box body 20 has a seat plate 21, which is fastened at both ends thereof to the two locating rods 101 and 102 of the base 10 by soldering. The seat plate 21 is provided on the top thereof with an inverted U-shaped plate 22 which has a top plate 221. The top plate 221 is provided in the center of the underside thereof with two locating spring pieces 23 and 24, which are each at one end thereof to the underside of the top plate 221 by soldering and are each provided in the underside thereof with an upper locating block 25, 26. The locating blocks 25 and 26 are respectively provided with a V-shaped slot 251, 261. The seat plate 21 is provided in the center of the top thereof with a lower locating block 27 which is in turn provided with two V-shaped slots 271 and 272. The slots 271 and 272 are provided respectively with a pointed edge 2710, 2720. The pointed edges 2710 and 2720 are opposite in location to the two pointed edges 2510 and 2610 of the V-shaped slots 251 and 261 of the two upper locating blocks 26 and 26. An imaginary line "A" is formed by connecting the pointed edges 2510 and 2710, whereas an imaginary line "B" is formed by connecting the pointed edges 2610 and 2720, as shown in FIG. 4. The seat plate 21 is further provided in the top thereof with two stop plates 28 and 29, which are opposite in location to the two V-shaped slots 271 and 272 of the lower locating block 27. The inverted U-shaped plate 22 is provided in a top plate 221 thereof with two bolts 30 and 31 which are fastened thereonto such that the two bolts 30 and 31 come in contact with the two locating spring pieces 23 and 24.

Figure 5:
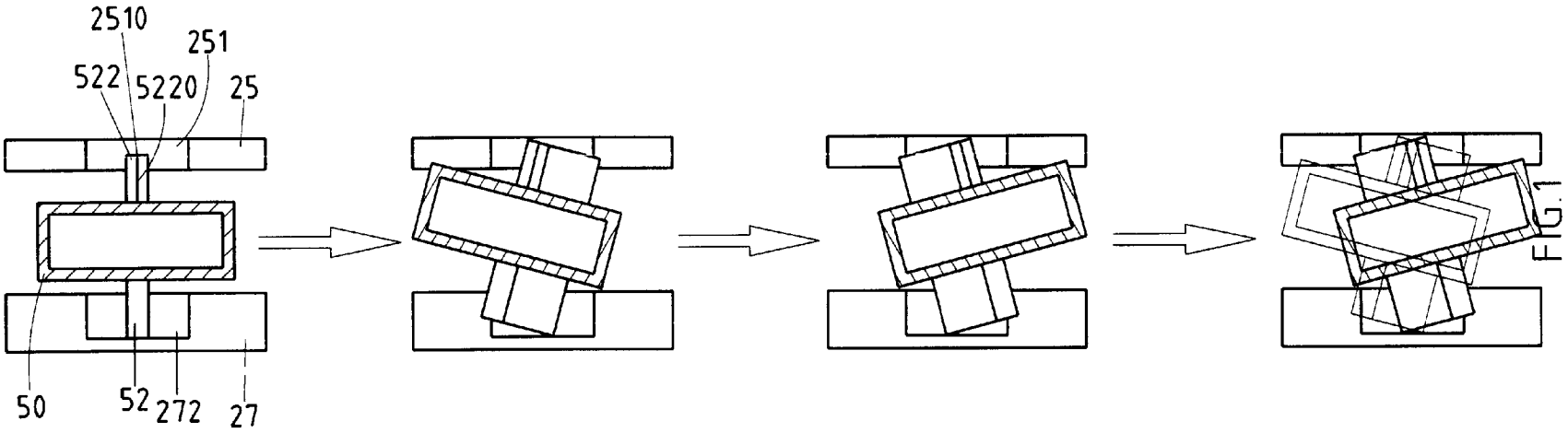
FIG. 5 shows a sectional schematic view of a seat rod and a pedal rod of the first preferred embodiment of the present invention in action.
Figure 6:
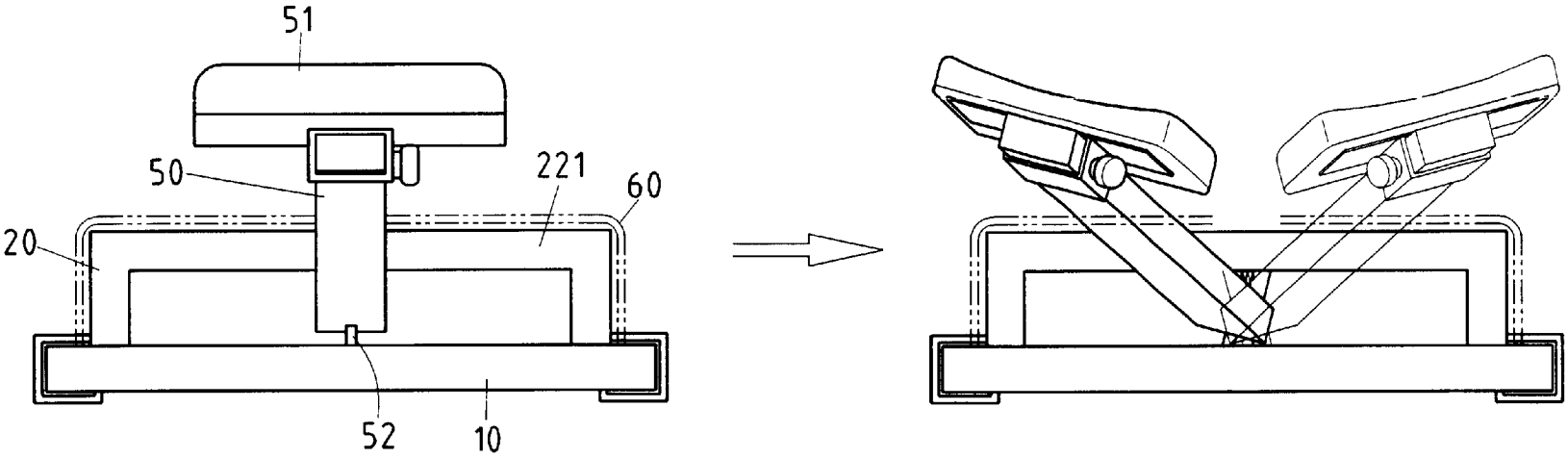
FIG. 6 shows a schematic plan view of the pedal rod of the first preferred embodiment of the present invention in action.
Figure 7:
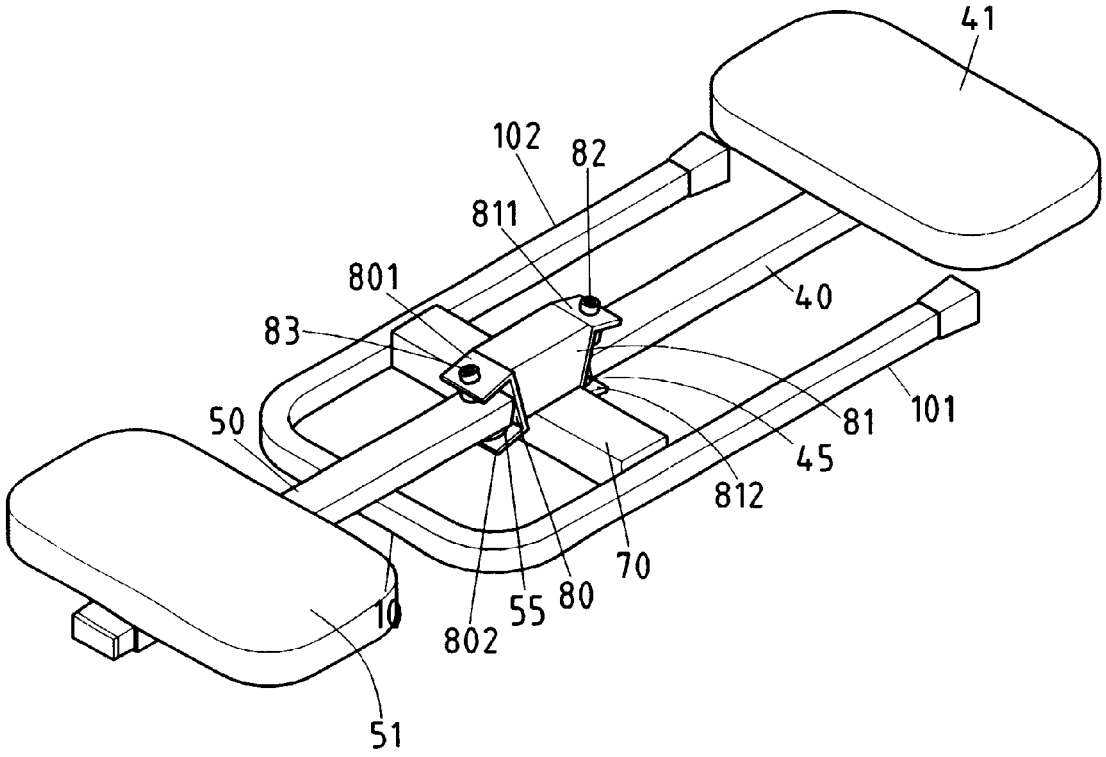
FIG. 7 shows a perspective view of a second preferred embodiment of the present invention.
Figure 8:
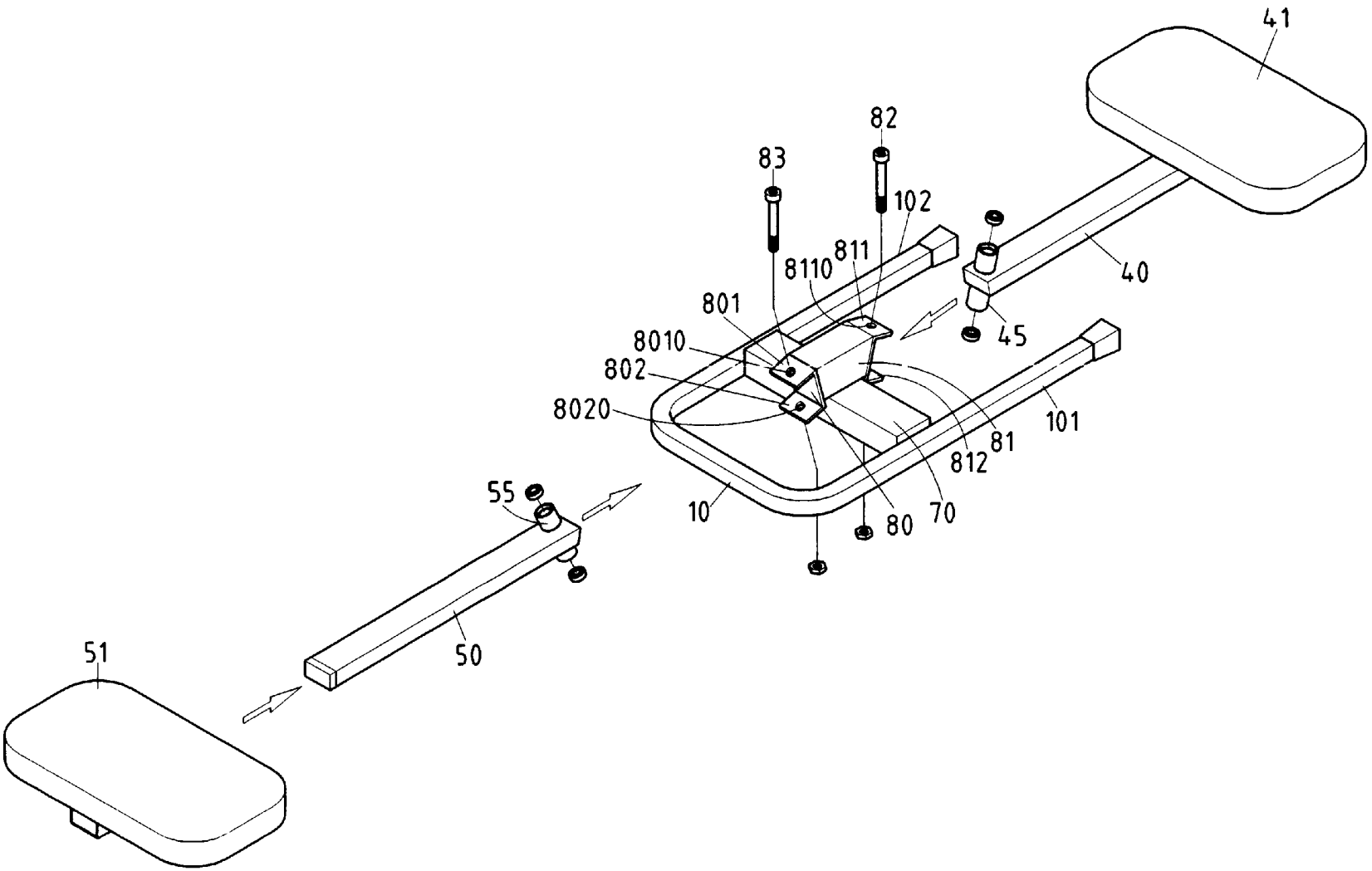
FIG. 8 shows an exploded view of the second preferred embodiment of the present invention.

The seat rod 40 is fastened at the outer end thereof to a seat pad 41, and the inner end thereof to a braking block 42 which is provided to a lower tangent surface 421 and an upper tangent surface 422 and is inserted into the box body 20 such that the lower tangent surface 421 is inserted into the lower slot 271 of the lower locating block 27, and such that the upper tangent surface 422 is inserted into the slot 251 of the upper locating block 25, thereby causing a pointed projection 4210 of the lower tangent surface 421 of the braking block 42 to come in contact with the pointed edge 2710 of the lower slot 271 of the lower locating block 27. The bolt 30 is fastened such that the bolt 30 presses against the first locating spring piece 23 to prevent the braking block 42 from becoming detached. The seat rod 40 is thus capable of swinging back and forth, as shown in FIGS. 5 and 6.

The pedal rod 50 is provided at the outer end thereof with a pedal pad 51, and at the inner end thereof with a braking block 52 which is in turn provided with a lower tangent surface 521 and an upper tangent surface 522. The braking block 52 is inserted into the box body 20 such that the lower tangent surface 521 of the braking block 52 is inserted into the lower slot 272 of the lower locating block 27, and such that the upper tangent surface 522 of the braking block 52 is inserted into the upper slot 261 of the upper locating block 26, thereby causing a pointed projection 5210 of the lower tangent surface 521 of the braking block 52 to come in contact with the pointed edge 2720 of the lower slot 272 of the lower locating block 27, and thereby causing a pointed projection 5220 of the upper tangent surface 522 of the braking block 52 to come in contact with the pointed edge 2610 of the upper slot 261 of the upper locating block 26. The second bolt 31 is fastened onto the top plate 221 of the inverted U-shaped plate 22 so as to push the second locating spring piece 24 downward to prevent the braking block 52 of the pedal rod 50 from becoming detached. The pedal rod 50 is thus capable of swinging back and forth, as shown in FIGS. 5 and 6.

The box cover 60 is used to cover the box body 20.

Figure 9:
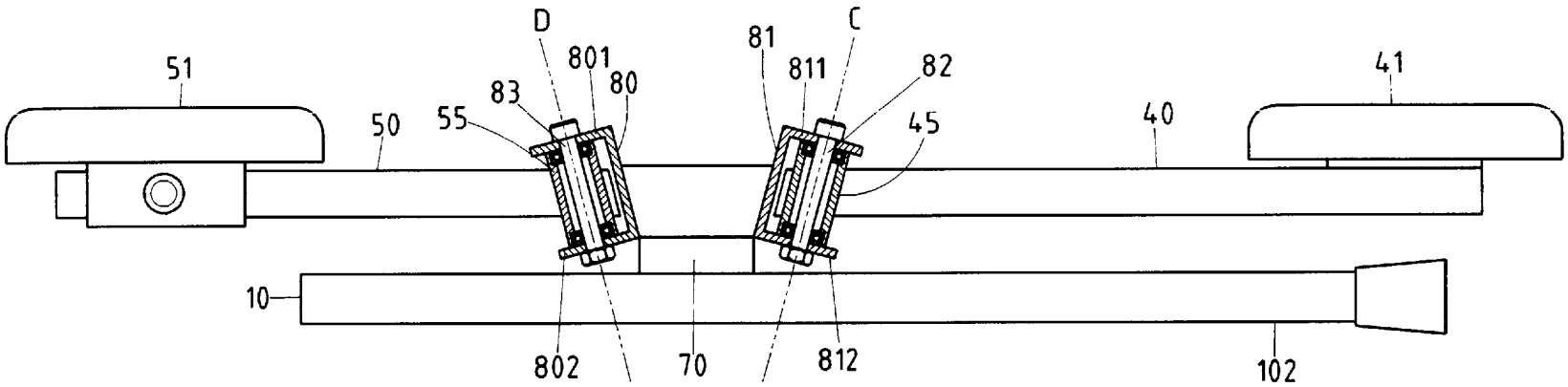
FIG. 9 shows a side sectional view of the second preferred embodiment of the present invention.
Figure 10:
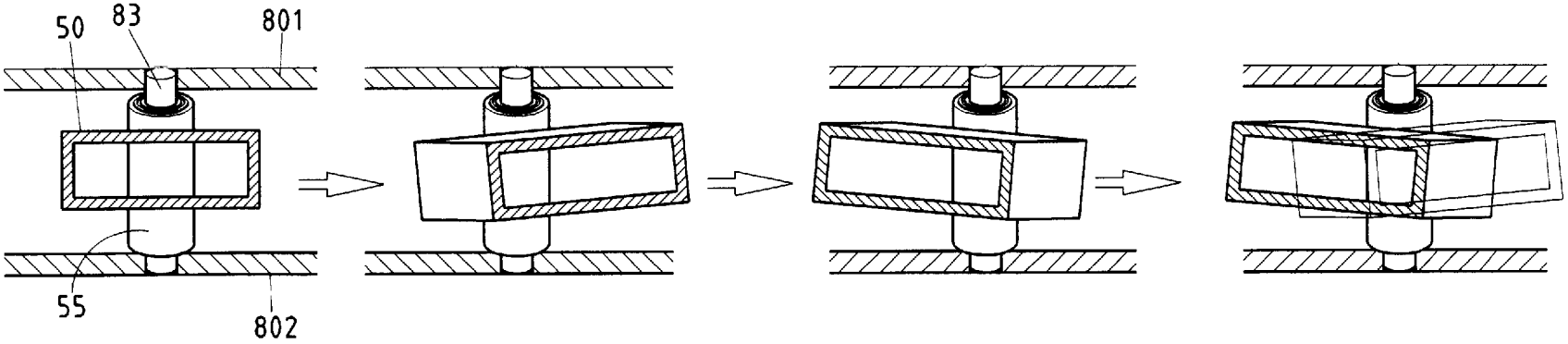
FIG. 10 shows a schematic view of a seat rod and a pedal rod of the second preferred embodiment of the present invention in action.

As shown in FIGS. 7-10, the exercise machine of the present invention further comprises a frame 70 which is fastened between the two locating rods 101 and 102 of the base 10. The frame 70 is provided on two sides of the center with two slanting and opening outwardly shaped mounts 80 and 81, which are respectively provided with a top plate 801, 811, and a bottom plate 802, 812, which are in turn provided with an upper through hole 8010, 8110, and a lower through hole 8020, 8120. An imaginary line "C" is formed by connecting the upper trough hole 8010 and the lower through hole 8020, whereas an imaginary line "D" is formed by connecting the upper through hole 8110 and the lower through hole 8120, as shown in FIG. 9. The seat rod 40 and the pedal rod 50 are fastened respectively at the inner end thereof to a shaft tube 45, 55, which are each respectively inserted into the two mounts 80 and 81. Two bolts 82 and 83 are inserted respectively into the two shaft tubes 45 and 55 via the upper through holes 8010 and 8110 of the top seat plates 801 and 811 of the two mounts 80 and 81 such that the bottom ends of the two bolts 82 and 83 are inserted respectively into the lower through holes 8020 and 8120 of the bottom seat plates 802 and 812 of the two mounts 80 and 81. The seat rod 40 and the pedal rod 50 are fastened pivotally to the mounts 80 and 81 such that the seat rod 40 and the pedal rod 50 are capable of swinging back and forth, as shown in FIG. 10.

Figure 11:
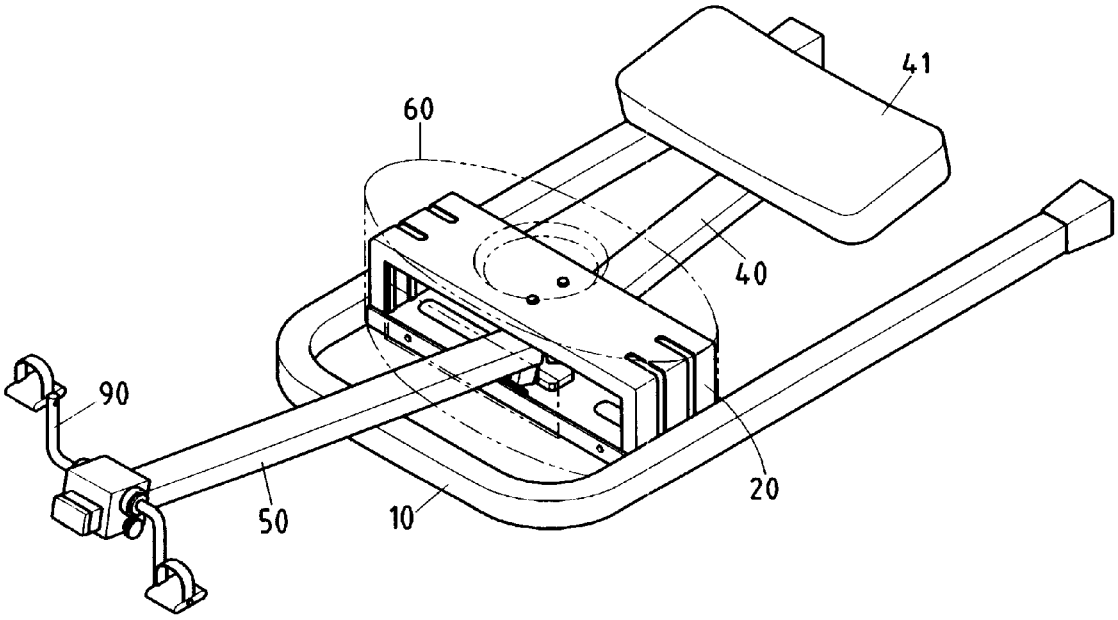
FIG. 11 shows a perspective view of a third preferred embodiment of the present invention.

As shown in FIG. 11, the pedal rod 50 of the exercise machine of the present invention is provided at the outer end thereof with two pedals 90 fastened pivotally thereto.

Figure 12:
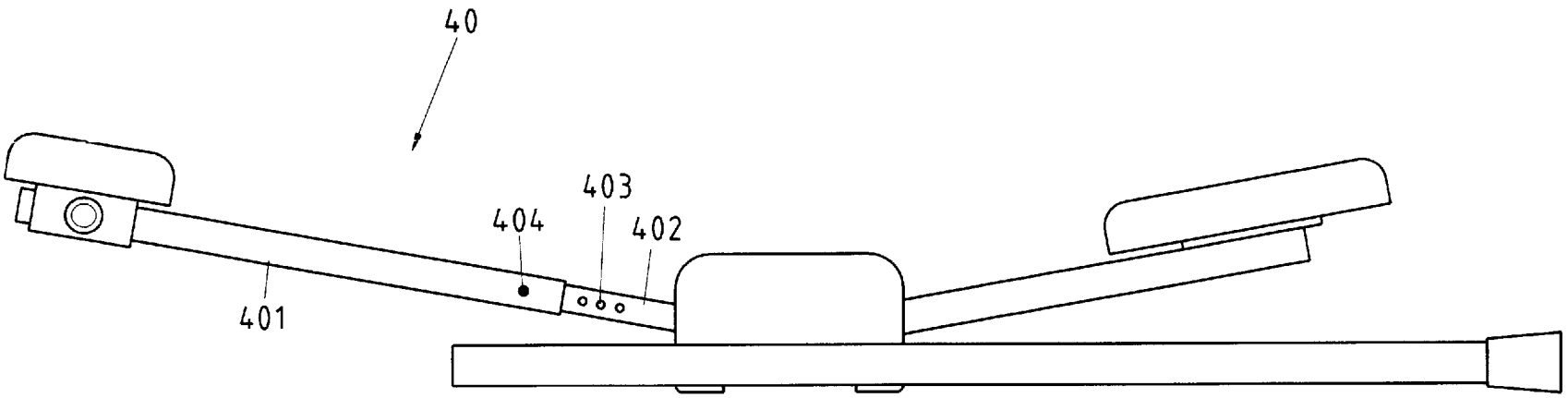
FIG. 12 shows a side plan view of a fourth preferred embodiment of the present invention.

As shown in FIG. 12, the seat rod 40 of the exercise machine of the present invention is formed of a primary tube 401 and a secondary tube 402 which is provided in the side wall thereof with a plurality of holes 403 engageable with a plurality of fastening bolts 404 by which the secondary tube 402 is detachably and adjustably fastened to the primary tube 401.

The exercise machine of the present invention has at least two advantages. In the first place, the present invention comprises the seat rod 40 and the pedal rod 50, which enable various parts of the body of an exerciser to be in action at the same time. The operations of the seat rod 40 and the pedal rod 50 are smooth because the pointed projections of the braking block 42 of the seat rod 40 and the braking block 52 of the pedal rod 50 are arranged on the two locating shaft lines "A" and "B".

The embodiments of the present invention described above are to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A exercise machine comprising:

a base rested on the ground surface and formed of two locating rods parallel to each other;

a box body having a seat plate which is fastened between said two locating rods of said base and is provided on a top thereof with an inverted U-shaped plate, said inverted U-shaped plate having a top plate which is provided in a center of a underside thereof with two locating spring pieces, said two spring pieces being fastened at one end thereof to an underside of said top plate by soldering and provided in an underside thereof with an upper locating block having a V-shaped slot, said seat plate further provided in a center of a top thereof with a lower locating block which is in turn provided with two V-shaped slots, with each having a pointed edge, said pointed edges of said lower locating block being opposite in location to said pointed edges of said upper locating block, said seat plate being further provided in the top thereof with two stop plates which are opposite in location to said V-shaped slots of said lower locating block, said inverted U-shaped plate being provided in a top plate thereof with two bolts fastened thereonto such that said bolts are in contrast with said two locating spring pieces;

a seat rod fastened at an outer end thereof to a seat pad, and at an inner end thereof with a braking block which is provided with a lower tangent surface and an upper tangent surface said block being inserted into said box body such that said lower tangent surface is inserted into said lower slot of said lower locating block and that said upper tangent surface is inserted into the slot of said upper locating block, thereby causing a pointed projection of said lower tangent surface of said braking block to come in contact with said pointed edge of said lower slot of said lower locating block, one of said two bolts being fastened such that said one bolt presses against said first locating spring piece to prevent said braking block from becoming detached, said seat rod being capable of swinging back and forth;

a pedal rod provided at an outer end thereof with a pedal pad, and at an inner end thereof with a braking block which is in turn provided with a lower tangent surface and an upper tangent surface said block being inserted into said box body such that said lower tangent surface of said braking block is inserted into said lower slot of said lower locating block, and that said upper tangent surface of said braking block is inserted into said upper slot of said upper locating block, thereby causing a pointed projection of said lower tangent surface of said braking block to be in contact with said pointed edge of said lower slot of said lower locating block, and thereby causing a pointed projection of said upper tangent surface of said braking block to come in contact with said pointed edge of said upper slot of said upper locating block whereby an other one of said two bolts is fastened onto said top plate inverted U-shaped plate so as to push said second locating spring piece to move downward to prevent said braking block of said pedal rod from becoming detached, said pedal rod being capable of swinging back and forth; and a box cover 60 for covering said box body.

2. The exercise machine as defined in claim 1 further comprising a frame which is fastened between said two locating rods of said base and is provided with two mounts, with each having a top plate and a bottom plate, said top plate and said bottom plate being provided with an upper through hole and a lower through hole, said seat rod and said pedal rod being fastened at an inner end thereof to a shaft tube which is inserted into said mounts and is provided with a bolt inserted thereinto via said upper through holes of said top seat plates of said mounts such that bottom ends of said two bolts are inserted into said lower through holes of said bottom seat plates of said mounts, said seat rod and said pedal rod being fastened pivotally to said mounts such that said seat rod and said pedal rod swing back and forth.

3. The exercise machine as defined in claim 1, wherein said pedal rod is provided at an outer end thereof with two pedals fastened pivotally thereto.

4. The exercise machine as defined in claim 1, wherein said seat rod is formed of a primary tube and a secondary tube which is provided with a plurality of holes engageable with a plurality of fastening bolts whereby said secondary tube is fastened detachably to said primary tube by said fastening bolts which are put through said holes of said secondary tube.

* * * * *